US005201589A

United States Patent [19]

Chun et al.

[11] Patent Number: 5,201,589

[45] Date of Patent: Apr. 13, 1993

[54] MARKING TOOL HOLDER FOR A PUNCH PRESS

[75] Inventors: Victor L. Chun, Holland; James R. Hunter, Chadds Ford; George Jaworski, Bala Cynwyd, all of Pa.

[73] Assignee: Murata Wiedemann, King of Prussia, Pa.

[21] Appl. No.: 479,944

[22] Filed: Feb. 14, 1990

Related U.S. Application Data

[63] Continuation-in-part of Ser. No. 354,945, May 22, 1989, abandoned.

[51] Int. Cl.[5] ..... B41J 1/54

[52] U.S. Cl. ..... 400/134; 101/3.1; 72/434

[58] Field of Search ..... 83/552, 616; 101/3.1, 101/4, 41, 42, 43, 44, 32; 173/119, 120, 121; 400/134; 72/434

[56] References Cited

U.S. PATENT DOCUMENTS

| | | | |
|---|---|---|---|
| 2,122,316 | 6/1938 | Ganio | 72/434 |
| 2,319,796 | 5/1943 | Cooper | 101/4 |
| 2,348,566 | 5/1944 | Papazian | 101/3.1 |
| 2,427,358 | 9/1947 | Kovach | 101/3.1 |
| 2,558,616 | 6/1951 | Johnson | 101/3.1 |
| 3,160,046 | 12/1964 | Bredow | 83/552 X |
| 3,168,863 | 2/1965 | McRae | 101/43 |
| 3,174,426 | 3/1965 | Boekeloo et al. | 101/42 |
| 3,527,130 | 9/1970 | Knehans | 83/552 |
| 3,540,339 | 11/1970 | Killaly | 83/552 X |
| 4,069,876 | 1/1978 | Pototsky | 173/119 |
| 4,476,781 | 10/1984 | Kubacki et al. | 101/3.1 |
| 4,569,267 | 2/1986 | Kingel | 83/552 |
| 4,929,276 | 5/1990 | Chun et al. | 83/552 |

FOREIGN PATENT DOCUMENTS

| | | | |
|---|---|---|---|
| 8809232 | 12/1988 | PCT Int'l Appl. | 83/552 |

*Primary Examiner*—David A. Wiecking
*Attorney, Agent, or Firm*—John R. Benefiel

[57] ABSTRACT

A marking tool holder (10) for a punch press, in which a plurality of marking tools (46) are mounted in an indexing carrier (38) for selective activation by the press ram (14). A non-positive connection effects driving of the preselected marking tool (46) to eliminate the need for precise adjustment of the marking tool position. In a first embodiment, a pair of very stiff springs (138) are interposed between a ram engaged plunger (124) and a striker (70), while in the second embodiment, a striker mass (158) attached to the striker (70) and carried in a body member (60) which is accelerated by the ram (14) to generate kinetic energy converted into a marking pressure when the marking tool (46) impacts the workpiece (W).

7 Claims, 4 Drawing Sheets

MARKING TOOL HOLDER FOR A PUNCH PRESS

CROSS REFERENCE TO RELATED APPLICATION

This application is a continuation-in-part of application Ser. No. 07/354,945, filed on May 22, 1989, now abandoned.

This invention concerns punch presses and more particularly punch presses having rotary turrets for holding tooling activated by a press ram. There have heretofore been developed punch presses having upper and lower turret plates, the upper turret holding a plurality of punching tools and the lower turret a plurality of corresponding dies. The turret plates are each indexed to align a selected punch and die beneath the punch ram to enable punching operation to be conducted on workpiece with the selected punch and die set.

There has also been developed indexing punch and die holders for use in such turret presses, in which the punch is rotated by an indexing drive to be reoriented for a particular application.

In a further refinement, there has herefore been provided so called "turret-within-a-turret" multitool punch holders, in which a plurality of punches or dies are mounted in a single holder mounted at one station in the turret. The holder itself is indexed to bring a selected tool into engagement with the ram so as to be driven by stroking of the ram.

The turret-within-a-turret design enables a much greater number of tools to be mounted on the upper and lower turret plates.

There often is required means for marking of the workpiece with alpha-numeric indicia, which in recent times is typically provided by laser markers, but it also is known to drive a marking tool into a workpiece by the press ram to form an impression on the workpiece surface.

Since a large number of marking tools is required, the turret-within-a-turret design is well suited to a marking tool application, and it has heretofore been proposed to load such turret with marking tools.

However, the marking tools in such proposal were positively driven by the ram, and precise, time-consuming adjustments in the position of each marking tool is required to avoid excessive forces being exerted on the tools and workpiece and at the same time insure adequate marking pressure.

SUMMARY OF THE INVENTION

The present invention comprises an arrangement for carrying out marking of a workpiece in a punch press by ram driving of a selected marking tool carried in an indexed turret by a non positive driving means interposed between the ram and a selected marking tool. In a first embodiment, the marking tool is driven by the ram via interposed springs which are sufficiently stiff to transmit the necessary marking force from the ram, but the springs are slightly compressed by the ram so that small variations in the marking tool position and ram stroke do not develop excessive (or insufficient) marking pressure to obviate the need for tool position adjustments.

In a second embodiment, the ram is employed to accelerate a separately movable striker mass, which is coupled to a marking tool. The ram acts to move a body member carrying the striker mass so as to allow relative downward movement of the striker mass, the body member movement arrested when a bumper included in the holder contacts the workpiece. The striker mass continues to move to exerts a marking pressure as the striker mass is decelerated by engagement of the marking tool on the workpiece. Again the marking pressure is not appreciably affected by small variations in tool position or ram stroke to avoid the need for individual tool position adjustments.

In both embodiments, a number of marking tools are carried in a rotary carrier in a circular array, and each tool is able to be indexed to an operative position coupled to a marking tool striker. The striker is carried in a body member non rotatably coupled to the punch press ram. The body member axially advances with the stroking of the ram until a bumper piece on the carrier contacts the workpiece, which arrests further movement of the body member and carrier, but allows continued descent of the ram since the coupling means therebetween accommodates relative axial movement.

In the first embodiment, the ram subsequently engages a plunger which extends above the body member to be engagable upon stroking of the ram. A striker driver is coupled to the plunger by stiff compression springs so that the marking pressure is limited by compression of the springs.

In the second embodiment, the marker tool is connected to a striker mass which is not directly contacted by the ram, but accelerated by being carried along with a body member, and when the body member downward movement is arrested by contact of a bumper with the workpiece, the striker mass and marker tool continue to move down until the kinetic energy of the striker mass is converted into marking pressure applied against the workpiece.

The marking tool holder according to the present invention has the advantage of not requiring precision adjustments of the marking tools while reliably developing proper marking pressure.

Another advantage is afforded by being able to compactly house a large number of marking tools, each of which may be selected for marking a particular workpiece by a relatively simple indexing holder.

DETAILED DESCRIPTION

Figure 1:
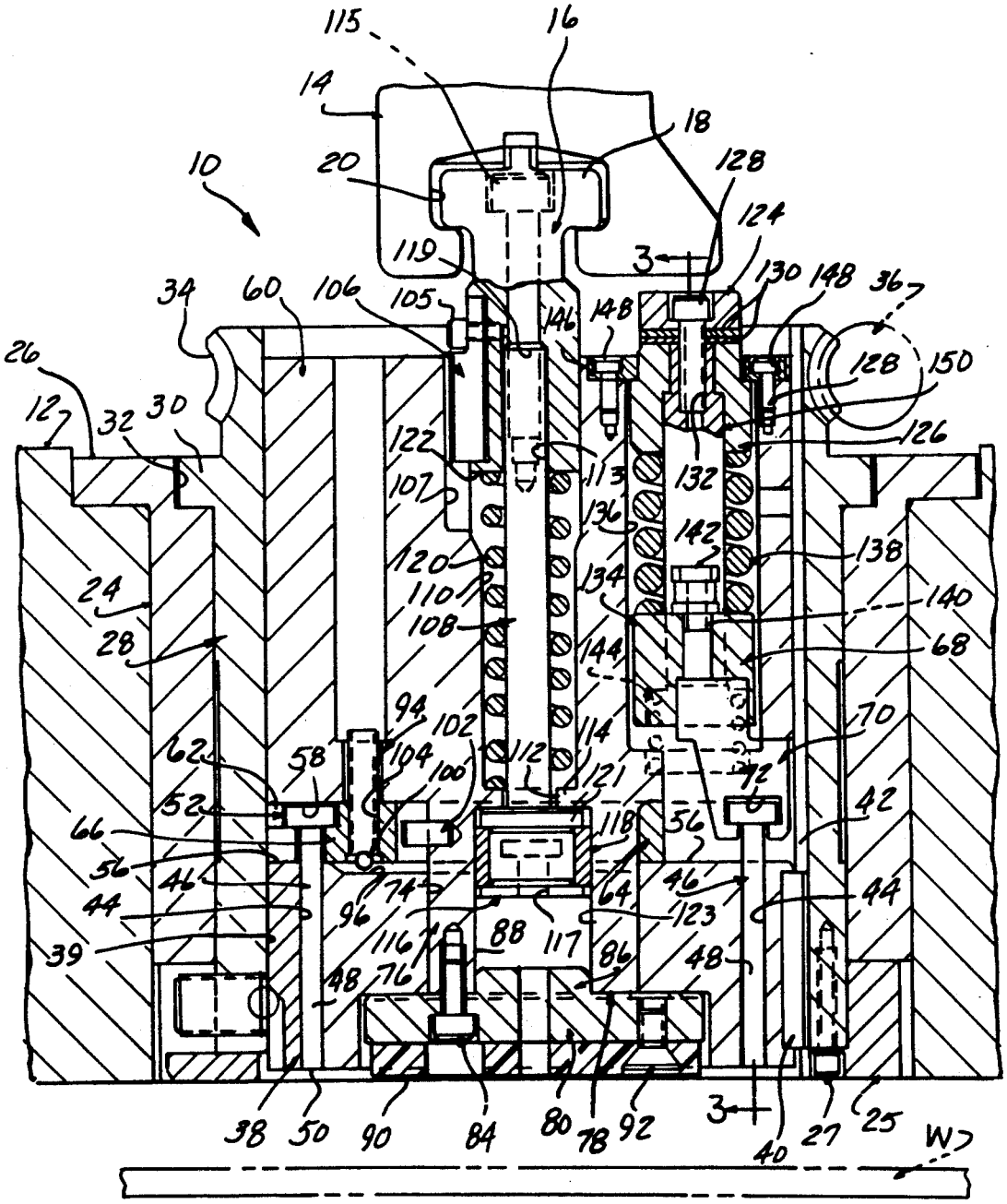
FIG. 1 is a longitudinal sectional view through an indexing machine tool holder according to the present invention together with a fragmentary view of a punch press ram coupled to the holder.

FIG. 1 shows an indexing marking tool holder 10 according to the present invention installed in an upper turret plate 12 of a rotary turret type punch press. The turret plate 12 is shown rotated to couple the punch press ram 14 to a coupling head 16 included in the holder 10. The coupling head 16 is configured with a conventional tee shaped head 18 which moves into a tee shaped opening 20 as the turret plate rotates about a vertical axis to carry the holder 10 into alignment below the ram 14 to establish an axially and rotationally fixed relationship therebetween.

The holder 10 is secured in the upper turret plate 12 in a mounting sleeve 24 having a flange 26 received in a counterbore and secured with screws (not shown)

The holder 10 is adapted to be indexed in the upper turret plate 12 by a rotary drive arrangement, including an index sleeve 28 having a flange 30 received in a counter bore 32 in the upper end of the mounting sleeve 24, a retainer ring 25 secured to the lower end with screws 27. The index sleeve 28 is formed with a worm gear 34 driven by a worm 36 to be rotated about its axis. The worm 36 is in turn driven by a rotary drive (not shown), to cause indexing of a cylindrical carrier 38 received within a bore 39 in the index sleeve 28 and coupled thereto by a key 40 attached to the carrier 38 and longitudinal keyway slot 42 formed along the bore 39 of index sleeve 28.

The carrier 38 is formed with a circular array of axial bores 44 distributed about the axis of the holder 10, each adapted to receive a respective marking tool 46. Each marking tool 46 has a shank portion 48 terminating in an end face 50 formed with the pattern for the impression to be marked therein.

Figure 2:
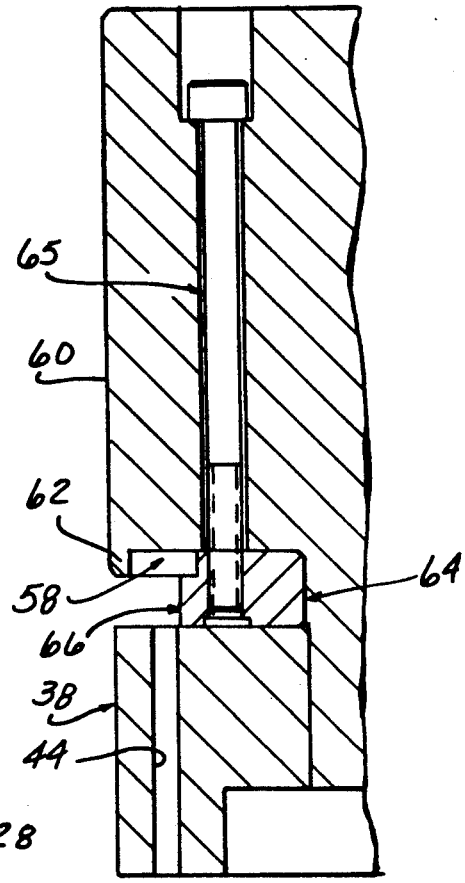
FIG. 2 is a fragmentary sectional view of a portion of the holder shown in FIG. 1.

The marking tools 46 each carry a flat head portion 52 at the upper end of the shank 46 which protrudes above the upper face 56 of the carrier 38. The head portion 52 of each of the marking tools 48 is received in an annular track 58 extending within the lower end of a holder body member 60 located above the carrier 38 and fit within the index sleeve 28. FIG. 2 shows that the track 58 is formed by an outer depending skirt 62 integral with the body member 60, and an inner guide ring 64 fixed to the lower face of the body member 60 by cap screws 65 threaded into bores in the guide ring 64. Guide ring 64 is formed with a lip 66 capturing the head portion 52 of each marking tool 46.

Referring again to FIG. 1 the guide ring 64 and skirt portion 62 are relieved at a localized region located beneath a axially extending striker assembly 68 mounted within the body member 60. The striker assembly 68 includes a striker member 70 formed with a recess 72 configured correspondingly to the track 58 and normally in alignment therewith to allow a particular selected marking tool 46 to be captured therein as the carrier 38 is indexed about its axis.

The carrier 38 is formed with an axially aligned bore 74, receiving an extension portion 76 of body member 60. A retainer plate 80 is affixed to the lower end face 78 of the extension portion 76 with screws 84. The retaining plate 80 has a plug portion 86 piloted into an axial bore 88 formed in the body member 60, the retaining plate 80 extending radially outwardly to capture the carrier 38. This arrangement insures that the carrier 38 and body member 60 move together axially while being relatively rotatable.

A bumper plate 90 is affixed to the lower face of the retainer plate with counter sunk screws 92, the lower surface of the bumper 90 protruding so as to be the point of first contact of the holder 10 with the upper surface of workpiece W to be marked as the holder 10 is lowered by stroking of the ram 14.

A detent plunger assembly 94 extends downwardly and includes a ball 100 engaging a recess 96 formed in the upper side of the carrier 38 at a "home" angular position, serving to securely locate the carrier 38 in a known angular position at assembly. A dowel 102 is employed to locate the guide ring 66 so as to align a through bore 104 with the plunger assembly 94.

As noted above the body member 60 is selectively coupled to the ram 14 by the rotation of the upper turret plate 12 to carry the coupling head 16 to be aligned with the ram 14, head 18 moving into opening 20 to establish an axial and rotational fixed connection therebetween.

The coupling head 16 is in turn keyed at 106 to the body member 60 to prevent relative rotation therebetween. The coupling head 16 is attached to an extension rod 108 by a capscrew 115 drawing the upper end of the rod section 108 against a shoulder 119 in a bore 113 machined into the lower end of the bore 110 of the body member 60, and extends through a reduced diameter bore 112 forming a flange 114. The flange 114 serves to engage and locate a first rod flange 121 on the lower end of the extension rod 108.

A compression spring 120 is interposed between the shoulder 114 and lower end face 122 of coupling member 16, urging the member to a raised position in the body member 60 with the first rod flange 121 against the flange 114.

A split bushing 118 is positioned between first rod flange 121 and a second rod flange 116 to guide extension rod 108 in a lower bore 123 in the body member 60.

The striker assembly 68 further includes plunger 124 protruding above the top of the body member 60, and secured to an upper slider 126 with capscrews 128 each received in a threaded bore 132 in the upper end of each of a pair of vertical guide rods 150. Shims 130 may be employed to vary the marking force by raising or lowering the plunger 124 slightly relative the ram 14.

The upper slider 126 and lower slider 134 are fitted within an axially extending passage 136 formed in the body member 60, and have a pair of stiff compression springs 138 interposed therebetween constituting in part the non-positive driving means acting between the ram 14 and striker 70. Solid resilient members or other compressible material or elements could alternatively be employed. The lower slider 134 is fixed to the striker 70 by receiving a threaded stem 140, secured with a threaded nut 142.

Relatively weak compression springs 144 located in facing pockets 145 and 147 of the lower slider 134 and bottom wall 61 of the body member 60 urge the upper slider 126 upwardly against a retainer plate 146 secured with screws 148.

Figure 3:
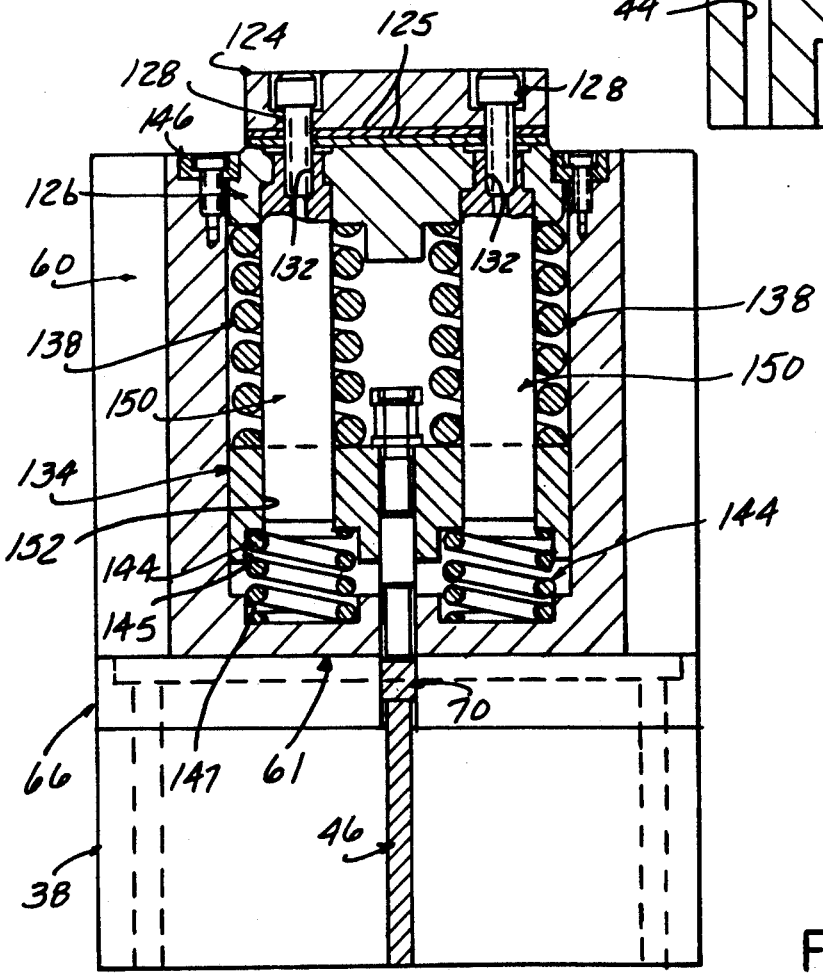
FIG. 3 is a view of the section 3—3 taken in FIG. 1.

FIG. 3 shows that the lower slider 134 is slidably fit over the pair of horizontally spaced vertical guide rods 150 projecting downwardly from the upper slider 126 to which they are fixed and passing partially into bores 152 with a slideable fit therein.

The guide rods 150 are each encircled by one of the compression springs 138 and return springs 144 acting on a respective side of the upper slider 126 and lower slider 134.

The compression springs 138 are selected to be very stiff i.e., on the order of 1850 pounds per inch of deflection and to operate at high working force levels i.e., 850–1175 pounds.

Since two springs 138 are employed, there is established a stiff driving connection to the marking tools 46 from the ram 14, but which springs limit the maximum pressure developed despite small variations in travel and location thereof.

Figure 4:
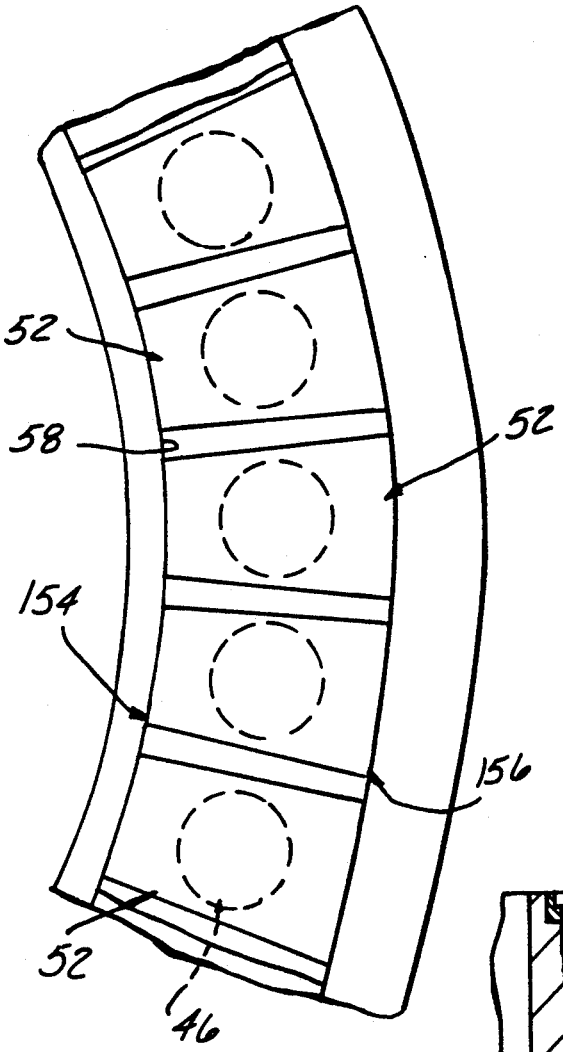
FIG. 4 is a fragmentary enlarged plan view of the circular array of marking tools contained in the holder of FIG. 1.

FIG. 4 shows that the head 52 of each of the marking tools 46 is formed of a generally trapezoidal shape, narrower on the inside edge 154, and both inside edge 154 and outside edge 156 may be slightly curved as necessary so as to be able to move easily through the annular track 58.

Operation

The holder 10 is installed in the upper turret plate 12, which is rotated to bring the coupling head 16 into engagement with the ram 14 as shown in FIG. 1. The index sleeve 28 is driven by the worm 36 to rotate the carrier 30 and bring a selected marking tool 46 into engagement with the striker 70 also as shown in FIG. 1.

The ram 14 is stroked, carrying the assembly of the body member 60, guide ring 64, plate 80 and bumper 90 downwardly until the bumper 90 contacts the upper surface of the workpiece W. The ram 14 continues downwardly, with the tee head member 16 telescoping into the body member 60, compressing the spring 120. The ram 14 then contacts the plunger 124, driving the upper striker 126 downwardly, and, acting through the stiff springs 138, causing the lower striker 134 to also descend, carrying the marking tool 46 in the striker 70 into contact with the workpiece W.

A slight compression of the springs 138 occurs when the marking tool 46 is pressed into the workpiece, and this compression accommodates small variations in the travel and location of the ends of the marking tools 46.

Figure 5:
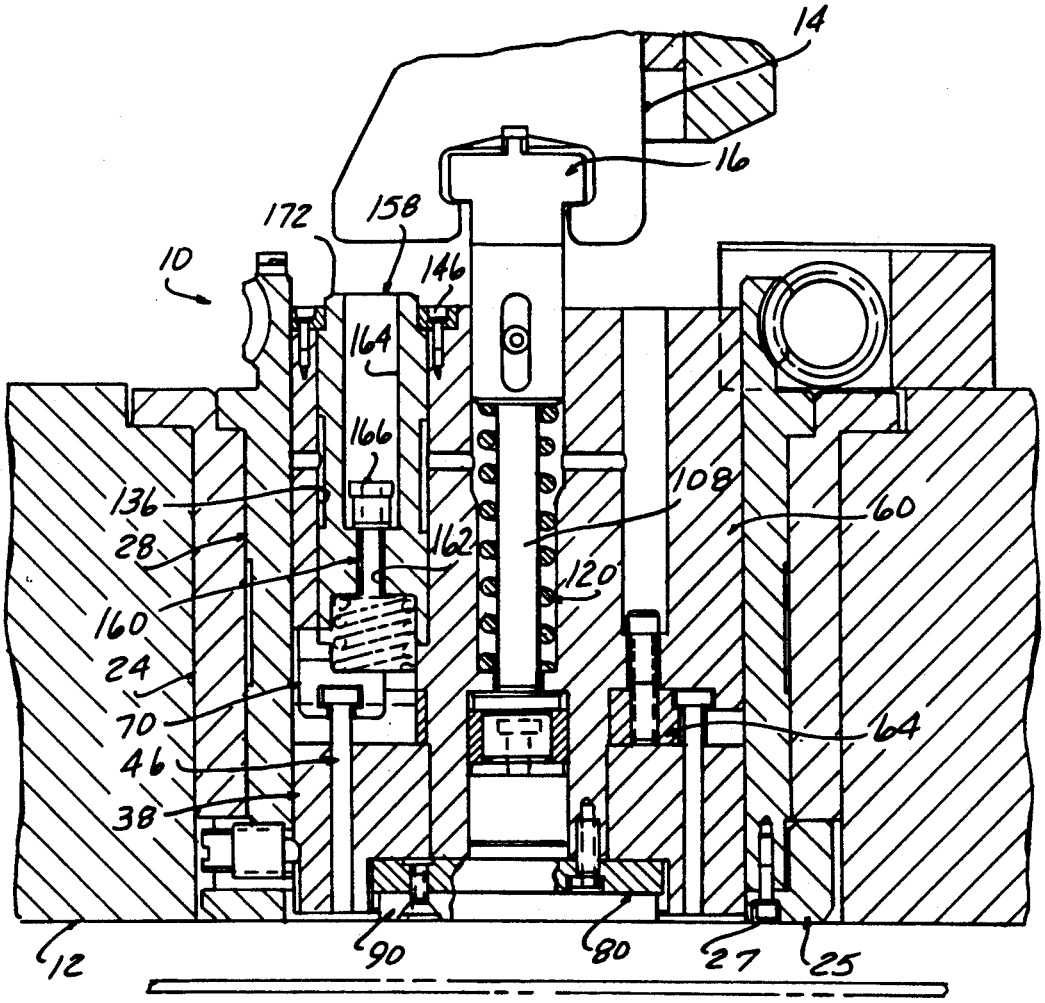
FIG. 5 is a longitudinal sectional view taken through a second embodiment of an indexing marking tool holder according to the present invention.

FIG. 5 shows a second embodiment of the indexing marking tool holder 10 according to the present invention.

In this embodiment, there is a similar arrangement of components of a holder 10 mounted in the upper turret 12 of a punch press including the coupling head 16 adapted to mate with the ram 14 of the punch press.

The holder 10 itself includes the mounting sleeve 24, indexing sleeve 28, carrier 38, body member 60, guide ring 64, plate 80 and bumper 90. The tee coupling head 16 is similarly coupled to the body member via extension and spring 120.

In this embodiment however, the non positive drive means comprises a striker mass 158, movably received in axial passage 136 extending into the top end of the body member 60. The striker 70 is fixedly attached to the striker mass 158 by an extension stem 160 integral with the striker extending into a through bore 162 and protruding into a counterbore 164 of the striker mass 158.

A threaded nut retainer 166 secures the striker stem 160 to fix the striker 70 thereto.

Figure 6:
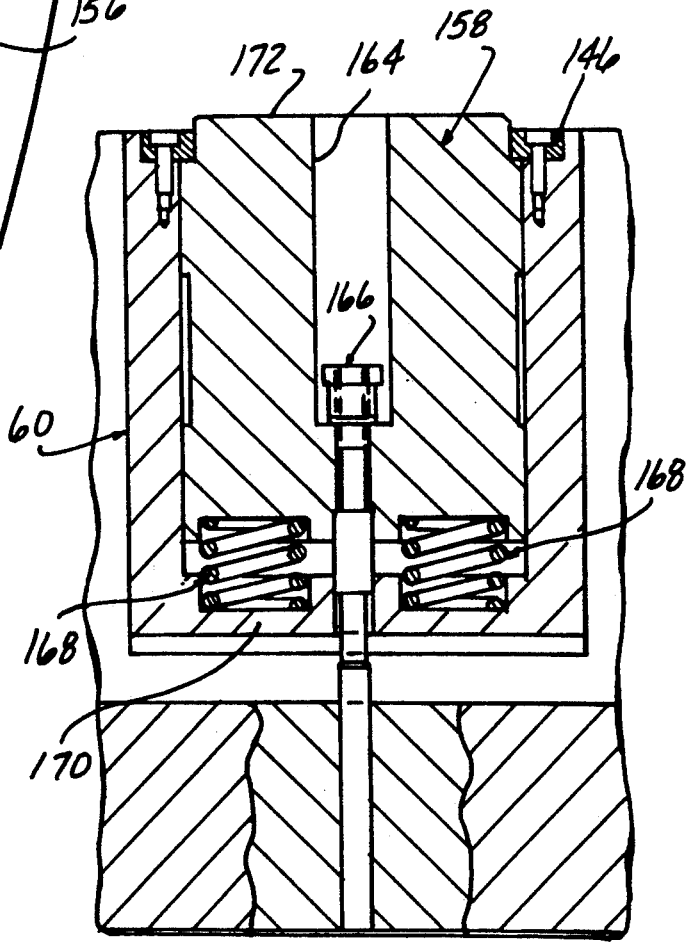
FIG. 6 is a fragmentary sectional view of the holder shown in FIG. 5.

FIG. 6 shows that the striker mass 158 is oblong in transverse section so as to enable a pair of side by side return springs 168 to act on a lower wall 170, urging the striker mass 158 upwardly against the retainer plate 146.

In this position, the upper end 172 of the striker mass 158 is well below the lowest point reached by the ram 14, so that direct driving does not occur at any time in the cycle of operation.

In operation, the striker mass 158 is accelerated by the motion of the ram 14 as it descends, being carried along with the body member 60 by the retainer 146. At the point the bumper 90 contacts the workpiece W, the movement of the body member 60 is arrested, but the striker mass 158 continues its downward motion against the resistance of the springs 168, carrying the marking tool 46 into engagement with the workpiece W. The kinetic energy of the striker mass 158 is converted into a marking pressure as the striker mass 158 is brought to rest by contact of the marking tool 46 with the workpiece.

It can be appreciated that the marking pressure developed is not closely dependent on a fixed location of the marking tool and is not appreciably affected by small variations in stroke or part location to thus provide the advantage of the present invention.

The mass of the striker mass 158, and the strength of the springs 168 can each be designed to achieve the proper marking pressure required for a given application by basic engineering principles well known to those skilled in the art.

We claim:

1. In combination with a marking tool holder (10) for a punch press of the type including a ram (14) adapted to be stroked and cause a selected one of a plurality of marking tools (46) carried in the holder (10) to be forced against the surface of a workpiece (W) and make an impression therein, driving means (124, 126, 138, 134, 150, 70) acting between said ram (14) and said selected marking tool (46) causing said movement of marking tool (46);

characterized by stiff spring means (138) interposed between said ram (14) and said selected marking tool (46), said driving means causing advance of said selected marking tool (46) a distance towards a workpiece such that said stiff spring means is only very slightly compressed by stroking of said ram (14) to force a marking tool (46) against the surface of a workpiece (W), whereby said interposed stiff spring means (138) accommodates slight variations in said marking tool position to insure proper marking pressure without adjustment of said marking too position.

2. The marking tool holder (10) according to claim 1 wherein said holder member is of the type including a body member (60), and means (16, 108, 120, 114) causing said ram (14) and said body member (60) to initially move together as said ram (14) is stroked until a portion (90) of said tool holder (10) contacts a workpiece (W), and thereafter allowing lost motion therebetween to allow continuing stroking of said ram (14) after contact with said workpiece (W), said non positive driving means including a plunger (124) contacted by said ram (14) during said lost motion movement thereof, said spring means (138) interposed between said plunger (124) and said marking tool.

3. The marking tool holder (10) according to claim 2 wherein said holder (10) further includes a carrier (38) positioned beneath said body member (60) carrying each of said plurality of marking tools (46) and means (28, 40, 42) rotating said carrier (38) to successively bring each marking tool (46) beneath said ram (14), said plunger (124) mounted to said body member (60) located directly beneath said ram (14).

4. The marking tool holder (10) according to claim 2 wherein said non positive driving means further includes an upper slider (126) attached to said plunger (124) and a lower slider (134), guide means (150) mounting each of said upper slider (124) and lower slider (134) for guided vertical movement in said body member (60) with said spring means (138) interposed.

5. The marking tool holder (10) according to claim 4 wherein said guide means (150) comprises a pair of parallel guide rods (150) mounted in a passage (136) formed in said body member (60), said upper slider (126) and said lower slider (134) fit onto said guide rods (150), and wherein a stiff spring (138) constituting said spring means encircles each of said guide rods (150).

6. The marking tool holder (10) according to claim 1 wherein said stiff spring means (138) has a spring rate on the order of 1850 lbs/inch of deflection.

7. In combination with a marking tool holder (10) for a punch press of the type including a ram (14) adapted to be stroked and cause a selected one of a plurality of marking tools (46) carried in the holder (10) to be forced against the surface of a workpiece (W) and make an impression therein, driving means (124, 126, 138, 134, 150, 70) acting between said ram (14) and said selected marking tool (46) causing said movement of marking tool (46);

a striker mass (158) accelerated by stroking of said ram (14), said striker mass (158) separately movable from said ram (14) from a rest position in the direction of movement of said ram (14), means (70) connecting said striker mass (158) to said selected marking tool (46) to be moved therewith; said ram (14) coupled to said body member (60) with a lost motion yielding connection means (16, 108, 120) allowing said ram (14) to initially move relatively towards said body member (60) when movement of said body member (60) is arrested by contact with a workpiece (W); a bumper (90) drivingly connected to said body member (10) arranged to contact a workpiece surface prior to contact of a marking tool (46) with said workpiece (W), upon stroking of said ram (14) whereby said ram (14) accelerates said striker mass (158) until said bumper (90) contacts a workpiece (W) and said striker mass (158) thereafter continues movement until contacting said workpiece (W) with said marking tool (46), kinetic energy of said striker mass (158) thereby generating a marking pressure.

* * * * *